United States Patent [19]

Klein et al.

[11] Patent Number: 4,516,502

[45] Date of Patent: May 14, 1985

[54] IMPACT PROJECTILE ASSEMBLY

[75] Inventors: Klaus-Walter Klein, Neuss; Jürgen Böcker, Oberhausen; Gerhard Glotz, Düsseldorf; Klaus Gersbach, Willich, all of Fed. Rep. of Germany

[73] Assignee: Rheinmetall GmbH, Düsseldorf, Fed. Rep. of Germany

[21] Appl. No.: 462,902

[22] Filed: Feb. 1, 1983

[30] Foreign Application Priority Data

Feb. 27, 1982 [DE] Fed. Rep. of Germany ..... 3207220

[51] Int. Cl.[3] ..... F42B 13/16

[52] U.S. Cl. ..... 102/523; 102/489; 102/703

[58] Field of Search ..... 102/514–519, 102/520–523, 703, 338, 489, 501, 503; 244/3.1

[56] References Cited

U.S. PATENT DOCUMENTS

| | | | |
|---|---|---|---|
| 3,038,382 | 6/1962 | Noyes . | |
| 3,412,681 | 11/1968 | Schirneker | 244/3.1 X |
| 3,665,681 | 5/1972 | Jaslow . | |
| 3,802,345 | 4/1974 | La Costa | 102/522 X |
| 4,051,763 | 10/1977 | Thomanek . | |
| 4,085,678 | 4/1978 | Heincker . | |
| 4,102,271 | 7/1978 | Bethmann . | |
| 4,108,072 | 8/1978 | Trinks et al. . | |
| 4,212,244 | 7/1980 | Flatau | 102/503 X |

FOREIGN PATENT DOCUMENTS

| | | | |
|---|---|---|---|
| 0069949 | 1/1983 | European Pat. Off. . | |
| 1811331 | 6/1970 | Fed. Rep. of Germany . | |
| 1428679 | 9/1977 | Fed. Rep. of Germany . | |
| 1491353 | 8/1967 | France . | |
| 2024405 | 8/1970 | France . | |
| 2341124 | 2/1977 | France . | |
| 2498312 | 1/1981 | France . | |
| 757170 | 9/1956 | United Kingdom . | |
| 2110799 | 6/1983 | United Kingdom | 102/521 |

*Primary Examiner*—Harold J. Tudor

*Attorney, Agent, or Firm*—Karl F. Ross; Herbert Dubno

[57] ABSTRACT

A subcaliber projectile assembly especially for attack against active armor has an enabling projectile disposed axially ahead of a main projectile and in line and in end-to-end relationship therewith in a common sabot. The fin structures of the two projectiles are designed to increase the resistance of the main projectile so that it is retarded relative to the enabling projectile and strikes the target only after the enabling projectile has depleted at least one level of defense along the line of attack.

6 Claims, 3 Drawing Figures

IMPACT PROJECTILE ASSEMBLY

CROSS REFERENCE TO RELATED APPLICATION

This application is related to the commonly owned copending application Ser. No. 213,171 filed Nov. 26, 1980 and the continuation-in-part Ser. No. 295,551 filed July 27, 1981 thereof.

FIELD OF THE INVENTION

Our present invention relates to an impact (inertial) projectile system and, more particularly, to a projectile assembly adapted to be fired from a barrel-type weapon and effective against structured targets, such as multilayer armor of the type recently developed for armored vehicles.

BACKGROUND OF THE INVENTION

In recent years, (see, for example, U.S. Pat. No. 4,051,763), sophisticated armors have been developed to replace the massive walls previously relied upon to protect a fortified space, such as the interior of a military vehicle, e.g. a tank, against attack by projectiles from without.

These sophisticated armors have been, for example, structural armors, comprising multiple layers of reinforcement which have to be removed successively before penetration into the interior is possible, and active armors in which the several layers are provided with respective charges which can be set off upon the approach of a projectile to cause premature explosion of the projectile or deflection thereof and thereby prevent significant damage by the attack.

A number of systems have been developed to overcome entirely or in part the advanced protection afforded by these multilayer armors, and one such approach is described, for example, in the commonly owned German application No. 2 948 542 and the aforementioned U.S. applications.

In this system, a projectile directed at the armored vehicle is provided with a plurality of inertial or impact members adapted to strike the target in succession in a main attack direction. This projectile can be provided with an auxiliary charge, i.e. a charge which is not originally used to propel the projectile assembly from the barrel of the weapon, to accelerate a leading inertial or impact member relative to the trailing inertial or impact member.

This system, whereby two inertial members successively, i.e. in time-spaced sequence, strike the same target along essentially the same line of attack, has proved to be of advantage, especially against active armor in which the first projectile can eliminate the defense while the second projectile can pierce into the armored space.

However, while this arrangement has been found to be effective for the purposes described, it has not been completely satisfactory since the firing of the auxiliary charge is complicated by the configuration of the projectile and, when the charge must be accommodated as described in that application, the main member is so weakened as to decrease its effectiveness in attack against the target.

OBJECTS OF THE INVENTION

It is thus the principal object of the present invention to provide a projectile assembly which is more effective against multilayer targets, and especially active armors than earlier weapon assemblies, and yet which is of simplified construction.

Another object of this invention is to provide a weapons assembly which is free from the disadvantages of earlier multi-impact projectiles of the type in which a number of inertial members are intended to strike the target successively along the same line or direction of attack.

Yet another object of our invention is to provide a projectile assembly of the type which comprises a plurality of inertial or impact members adapted to restrike a target in succession along a common line of attack but wherein the wall of the body of a main impact member need not be weakened for this purpose.

Still another object of this invention is to provide an improved projectile assembly which can assure successive impacts of inertial or impact members along a common line of attack against a target without the complex auxiliary charges and firing systems which were previously required.

SUMMARY OF THE INVENTION

These objects and others which will become apparent hereinafter are attained, in accordance with the present invention, by providing a projectile assembly with a sabot enabling the assembly to be fired as a subcaliber projectile from a barrel-type weapon, and a plurality of elongated impact or inertial projectile members axially aligned along the axis of the sabot and disposed in an end-to-end contiguous relationship and contact with a small impact projectile forming the enabling projectile member or accessory projectile member being disposed ahead of the main or larger projectile member.

We have chosen to describe the projectile members as an "enabling" or accessory projectile member and a main projectile member because, in the system of the invention, the principal prupose of the leading projectile member, on attack, is to deplete a defense of the armor and thus facilitate or enable penetration of the succeeding or main projectile member. Naturally, when two or more defensive layers are provided, two or more enabling or accessory impact projectiles can be provided ahead of the main projectile and then these additional accessory projectiles will be in an end-to-end contact with each other and/or with the main projectile in a head-to-tail relationship.

While it is possible to provide the sabot or drive cage of the subcaliber assembly only around one of the projectile members and to provide other means for connecting the projectile members in an end-to-end contacting relationship, we prefer to provide all of the members, at least in part, within a common drive cage or sabot and thus to utilize the sabot to connect them together. In the latter case, the nose of the leading impact member may project from the front end of the drive cage or sabot while the tail and any fin structure of the rearmost impact member may lie rearwardly of the drive cage or sabot to contribute to the guidance of the assembly as it emerges from the barrel.

While the charge for propelling the assembly may be provided in a cartridge behind the projectile assembly and supplied thereafter into the barrel, in the preferred mode of the invention, a casing surrounds at least the rear end of the sabot and contains the propellant which, when fired, propels the assembly from the barrel.

According to another feature of the invention, each of the impact or inertial members, which need not have penetration or other charges carried thereby, can have a pointed nosepiece and a tail fin assembly, with the nosepiece of a successive impact or inertial member engaging in a recess in the tail assembly of the preceding impact or inertial member.

Furthermore, when the assembly utilizes a common drive cage or sabot for all of the impact or inertial members, recesses are formed between the segments of the sabot to accommodate the intermediate tail fin structures along the assembly.

The parts of the members which meet in a head-to-tail relationship, according to the invention, can be shaped to be complementary and to interfit. The drive cage may be a so-called pull sabot having only a single annular seal for engagement with the barrel, although it can also be a double-seal sabot.

When means must be provided to ensure that the main impact member will be retarded relative to the leading impact member, this means can be in the form of dimensioning the friction forces upon the main member to exceed those upon the leading or accessory member or members to provide the time-space relationship between the impact of the two members. This can be assured by appropriate dimensioning of the fin structures of the members.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
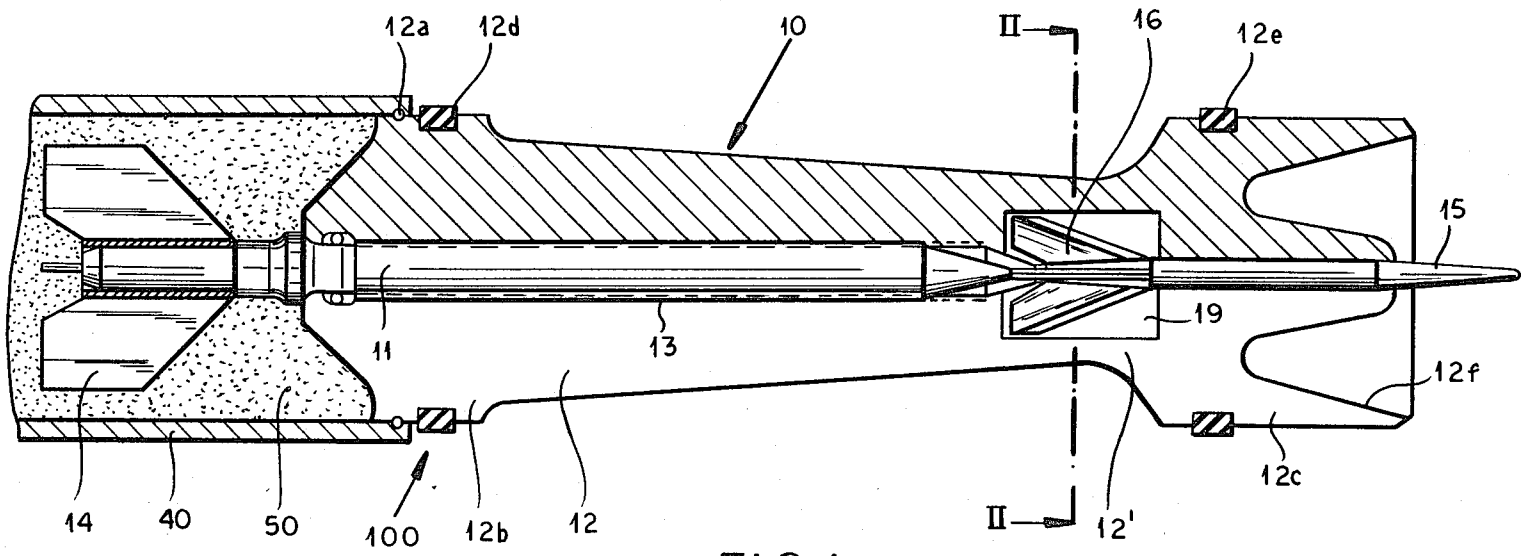
FIG. 1 is a partial section through a projectile assembly embodying the invention.
Figure 2:
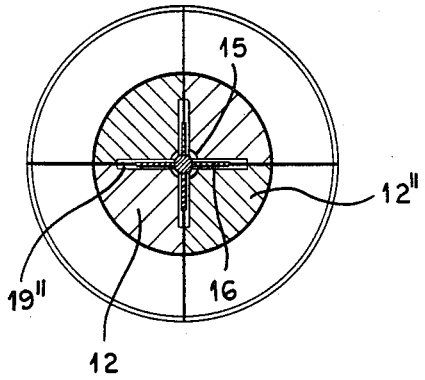
FIG. 2 is a section taken along the line II—II of FIG. 1.

FIGS. 1 and 2 show a round 100 which can be fired in a barrel-type weapon and which comprises a casing 40 closely surrounding the drive cage or sabot 12 of a projectile assembly 10 forming a subcaliber projectile for the barrel-type weapon.

Behind the projectile assembly 10, the casing 40 is filled with a propellant 50 which can be ignited by a primer or other means conventional in the art and not illustrated here.

The round is intended to be fired from an antitank cannon or like weapon and to attack multilayer and preferably active armor, e.g. armor surrounding a burner or forming a wall of a military vehicle such as a tank.

In the assembly of this invention, a first impact or inertial projectile member 11 is provided as the main inertial member and is preceded by a second impact or inertial member 15. The two members are in an auxiliary contiguous relationship, i.e. end-to-end contact, along the axis of the projectile assembly. The accessory member 15 is intended to attack the target shortly before the attack of the main projectile member 11 along the same line.

The two impact inertial projectile members 11 and 15 are surrounded for part of their respective length by a common drive-cage or sabot 12 and the case is axially coupled to at least the rearmost projectile 11 by a screw thread-like array of formations or teeth so that, upon acceleration of the sabot through the barrel, at least the rearmost projectile member is entrained positively therewith.

Both of the projectile members 11, 15 are formed with pointed noses and tail fin structures 14, 16 and to receive the intermediate tail fin structure 16, a forward portion 12' of the sabot 12 is provided with a recess or compartment 19.

The sabot is composed of segments 12'' which are held together by a frangible wire **12*a* and which define annular bosses 12*b* and 12*c* formed with annular seals 12*d* and 12*e***.

A pocket **12*f*** is formed at the leading end of the sabot.

Upon the firing of the round in the gun barrel, propellant gases drive the assembly 10 through the barrel which is sealed against the projectile assembly by the rings **12*d* and 12*d***.

When the projectile assembly encounters the resistance of the air outside the barrel, the pressure in the air pocket **12*f* spreads the segments 12'' apart and tears the sabot from the two projectile members 11 and 15 which continue on their line of travel to the target. The fin assemblies of these projectiles are dimensioned so that the main projectile 11 encounters somewhat more air resistance and is retarded somewhat by comparison with the accessory or enabling projectile member 15 which first encounters the target and thereby depletes at least the first defense layer of the armor. Thereupon the second or main projectile member 11** can penetrate the armor.

Apart from the aerodynamic retardation induced by varying the geometry of the fin assemblies, it is possible to provide other contours of the two projectile members which may differ to bring about the time-spaced separation of the two members.

Generally speaking, it is preferable that the mass of the leading member be less than the mass of the main member although, of course, any other relationship of the masses of the two or more members can be chosen. It is only important to appreciate that whatever the relationship, the mass of the last member to encounter the armor should be sufficient to enable to penetrate or destroy the attackable target.

Naturally the assembly 10 need not be utilized in a cartridge round but may be inserted into the barrel separately from the means generating the propellant charge, i.e. can be inserted separately from a cartridge containing the charge.

Figure 3:
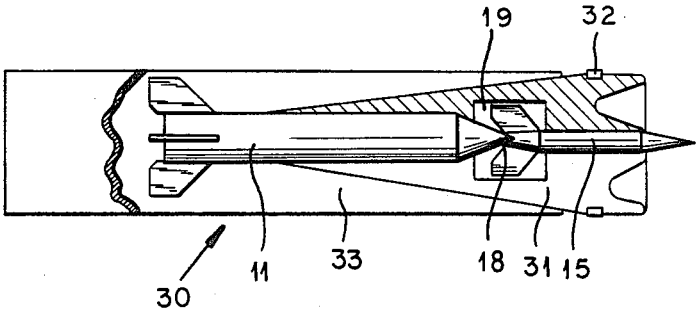
FIG. 3 is a diagrammatic section through either embodiment of the invention utilizing a pull sabot.

Another round-type munition is shown in FIG. 3 in which the impact projectiles 11 and 15 are surrounded by a Pull-type drive cage or sabot which can have a simple flask or bottle configuration and can form a greater propellant-receiving space 33 in the cartridge casing 30, a greater ratio of propellant charge to the size of the projectile assembly means a greater muzzle velocity of the projectile members 11 and 15.

Here also the recesses 19 are provided to accommodate the fins (see also FIG. 2).

The end of the leading member 15 may have a conical recess complementary to and accommodating the conical nose piece of the trailing member 11. A screw-thread like tooth arrangement can be provided here as well to couple the drive cage to the main member 11 and, of course, a similar set of teeth can be provided to engage the accessory or enabling projectile 15.

We claim:

1. A subcaliber projectile assembly for firing from a barrel-type weapon to attack a multilayer armored target, comprising:

an elongated sabot comprising a plurality of axially extending segments separable along axial planes, said segments defining a recess close to a leading air-catching end of the sabot;

a relatively small inertial enabling projectile received in said end of said sabot and having a fin stabilizer received in said recess;

a relatively large main inertial subsequently attacking projectile received in said sabot behind said enabling projectile and having a fin stabilizer disposed rearwardly of said sabot, said segments and the periphery of said main projectile being formed with mating formations enabling entrainment of said main projectile with said sabot until said segments of said sabot separate, said projectiles having aerodynamic configurations such that said enabling projectile reaches said target ahead of said main projectile; and at least one band surrounding said segments for releasably retaining same against said projectiles and holding said formations in mutual engagement.

2. The projectile assembly defined in claim 1 wherein the trailing end of said enabling projectile is formed with a recess form-fittingly receiving a nose at the leading end of said subsequently attacking projectile.

3. The projectile assembly defined in claim 2 wherein said sabot is a pull sabot.

4. The projectile assembly defined in claim 2, further comprising means for retarding the flight of said subsequently attacking projectile relative to said enabling projectile to establish a time-spaced sequence of attack of said projectile on said target.

5. The projectile assembly defined in claim 4 wherein the last mentioned means includes means for imparting different aerodynamic resistances to said projectiles.

6. The projectile assembly defined in claim 5 wherein said different aerodynamic resistances are the result of different configurations of said fin structures.

* * * * *